US006746312B2

(12) United States Patent
Torii et al.

(10) Patent No.: US 6,746,312 B2
(45) Date of Patent: Jun. 8, 2004

(54) POLISHING METHOD AND POLISHING APPARATUS

(75) Inventors: Hiroomi Torii, Tokyo (JP); Hiroshi Kojima, Tokyo (JP); Suguru Ogura, Tokyo (JP); Soichi Isobe, Tokyo (JP)

(73) Assignee: Ebara Corporation, Tokyo (JP)

( * ) Notice: Subject to any disclaimer, the term of this patent is extended or adjusted under 35 U.S.C. 154(b) by 33 days.

(21) Appl. No.: 09/864,229

(22) Filed: May 25, 2001

(65) Prior Publication Data

US 2002/0002028 A1 Jan. 3, 2002

(30) Foreign Application Priority Data

May 26, 2000 (JP) ..... 2000-156690

(51) Int. Cl.[7] ..... B24B 1/00
(52) U.S. Cl. ..... 451/41; 451/289; 451/8
(58) Field of Search ..... 451/41, 56, 285, 451/286, 287, 288, 289, 8, 9, 6

(56) References Cited

U.S. PATENT DOCUMENTS 5,882,248 A * 3/1999 Wright et al. ..... 451/285
5,957,751 A * 9/1999 Govzman et al. ..... 451/8
6,132,294 A * 10/2000 Lin ..... 451/41
6,280,291 B1 * 8/2001 Gromko et al. ..... 451/8
6,328,629 B1 12/2001 Togawa et al.
6,336,846 B1 * 1/2002 Park et al. ..... 451/41

FOREIGN PATENT DOCUMENTS

EP 0 990 485 4/2000

* cited by examiner

*Primary Examiner*—Dung Van Nguyen
(74) *Attorney, Agent, or Firm*—Wenderoth, Lind & Ponack, L.L.P.

(57) ABSTRACT

The present invention relates to a polishing method and apparatus for polishing a workpiece such as a semiconductor wafer to a flat mirror finish. A polishing liquid is supplied onto a polishing cloth attached on a turntable, and a semiconductor wafer to be polished is held by a top ring. The turntable and the top ring are rotated, respectively. A surface, to be polished, of the semiconductor wafer held by the top ring is pressed against the polishing cloth on the turntable to polish the semiconductor wafer. When a polished semiconductor wafer held by the top ring is to be removed from the polishing cloth on the turntable, a relative speed of the turntable and the top ring is increased as compared with a relative speed of the turntable and the top ring at a period of polishing.

26 Claims, 4 Drawing Sheets

POLISHING METHOD AND POLISHING APPARATUS

BACKGROUND OF THE INVENTION

1. Field of the Invention

The present invention relates to a polishing method and apparatus, and more particularly to a polishing method and apparatus for polishing a workpiece such as a semiconductor wafer to a flat mirror finish.

2. Description of the Related Art

Recent rapid progress in semiconductor device integration demands smaller and smaller wiring patterns or interconnections, and also narrower spaces between interconnections which connect active areas. One of the processes available for forming such interconnections is photolithography. Although a photolithographic process can form interconnections that are at most 0.5 $\mu$m wide, it requires that surfaces on which pattern images are to be focused by a stepper be as flat as possible because a depth of focus of an optical system is relatively small. However, conventional apparatuses for planarizing semiconductor wafers (substrate-like workpieces), such as self-planarizing CVD apparatus or etching apparatus, fail to produce completely planarized surfaces on semiconductor wafers. Recently, it has been attempted to planarize semiconductor wafers with a polishing apparatus which is expected to easily achieve complete planarization of the semiconductor wafers as compared with the above conventional apparatuses. Such a process is called Chemical Mechanical Polishing (CMP) in which semiconductor wafers are chemically and mechanically polished while supplying a polishing liquid comprising abrasive particles and a chemical solution such as alkaline solution.

FIG. 1 is a schematic view showing a basic structure of this type of polishing apparatus. As shown in FIG. 1, the polishing apparatus has a turntable 1 with a polishing cloth 11 attached thereon and constituting a polishing surface, and a top ring 2 for holding a semiconductor wafer (workpiece) W in such a manner that a surface, to be polished, of the semiconductor wafer W faces the turntable 1. The top ring 2 is connected to a lower end of a top ring shaft 3 via a ball joint 4 so as to be tiltable with respect to the top ring shaft 3. The semiconductor wafer W to be polished is pressed against the turntable 1 under a certain pressure by the top ring 2 while the turntable 1 and the top ring 2 are independently being rotated, and the surface of the semiconductor wafer W is polished to a flat mirror finish while a polishing liquid Q is being supplied from a polishing liquid supply nozzle 5. In this case, the surface, to be polished, of the semiconductor wafer W is brought into sliding contact with an upper surface of the polishing cloth 11 while following an inclination of the upper surface of the polishing cloth 11 via the ball joint 4.

As a polishing cloth attached on a turntable, a polishing cloth made of non-woven fabric has heretofore been employed. Higher levels of integration achieved in recent years for ICs and LSI circuits demand smaller steps or surface irregularities on a polished surface of a semiconductor wafer. In order to meet such a demand, there has been used a polishing cloth made of a hard material such as polyurethane foam.

After a semiconductor wafer W is polished by the polishing apparatus, it is necessary to remove the semiconductor wafer W from the polishing surface (the polishing cloth 11) on the turntable 1. However, a large surface tension acts between the polishing cloth 11 and the semiconductor wafer W due to polishing liquid Q interposed therebetween. Accordingly, if the top ring 2 holding the semiconductor wafer W is lifted at a polishing position in order to remove the semiconductor wafer W from the polishing cloth 11, there are some cases in which only the top ring 2 is lifted and the semiconductor wafer W adheres to the polishing cloth 11 so at to be left on the polishing cloth 11.

Such a problem can be solved by an overhanging action of the top ring. In the overhanging action, after the polishing process is completed, the top ring 2 is not lifted at the polishing position, but is moved to an outer circumferential edge of the polishing cloth 11 to partly expose a polished surface of a semiconductor wafer W beyond the outer circumferential edge of the polishing cloth 11, and is then lifted to remove the semiconductor wafer W from the polishing cloth 11. This overhanging action allows surface tension between the polishing cloth 11 and the-semiconductor wafer W to be reduced, and the semiconductor wafer W can reliably be separated or removed from the polishing cloth 11.

As described above, with the overhanging action, the surface tension between the polishing cloth 11 and the semiconductor wafer W can be reduced. However, the top ring 2 may tilt when the polished semiconductor wafer W projects from the outer circumferential edge of the polishing cloth 11. In this case, the semiconductor wafer W is intensively pressed at the outer circumferential edge of the polishing cloth 11, so that the semiconductor wafer W is cracked or scratched.

Polishing capability of a polishing cloth is gradually deteriorated due to a deposit of abrasive particles and ground-off particles of semiconductor material, and due to changes in the characteristics of the polishing cloth. Therefore, if the same polishing cloth is used to repeatedly polish semiconductor wafers, a polishing rate of the polishing apparatus is lowered, and polished semiconductor wafers tend to suffer polishing irregularities. Therefore, it has been customary to condition the polishing cloth according to a process called "dressing" for recovering a surface of the polishing cloth with a diamond dresser or the like before, after, or during polishing.

When a diamond dresser dresses a polishing surface of polishing cloth 11, it scrapes a thin layer off the polishing cloth 11. Therefore, after the polishing surface of the polishing cloth has been dressed many times, it becomes irregular, i.e. loses its planarity, thereby causing formation of steps. As a result, during movement of a polished semiconductor wafer W to the outer circumferential edge of the polishing cloth 11 in the aforementioned overhanging action, the semiconductor wafer W may be cracked or scratched because of the irregularities of the polishing cloth 11.

SUMMARY OF THE INVENTION

The present invention has been made in view of the-above drawbacks. It is therefore an object of the present invention to provide a polishing method and apparatus which can easily and safely remove a polished workpiece from a polishing surface, and can increase throughput.

According to an aspect of the present invention, there is provided a polishing method comprising: rotating a turntable having a polishing surface thereon, and a top ring for holding a workpiece to be polished, respectively; pressing a surface, to be polished, of the workpiece held by the top ring against the polishing surface on the turntable to polish the workpiece; and increasing a relative speed of the turntable and the top ring when a polished workpiece held by the top ring is to be removed from the polishing surface on the turntable, as compared to a relative speed of the turntable and the top ring at a period of polishing.

According to a preferred aspect of the present invention, a rotational speed of the turntable is increased as compared to a rotational speed of the turntable at a period of polishing to increase the relative speed of the turntable and the top ring.

According to another preferred aspect of the present invention, rotational speeds of the turntable and the top ring are respectively increased as compared to rotational speeds of the turntable and the top ring at a period of polishing to increase the relative speed of the turntable and the top ring.

According to another aspect of the present invention, there is provided a polishing apparatus for polishing a workpiece to be polished, comprising: a turntable having a polishing surface thereon; a top ring for holding the workpiece to be polished and pressing the workpiece against the polishing surface on the turntable; a motor for rotating the turntable; and a controller for controlling a rotational speed of the motor, wherein when a polished workpiece held by the top ring is to be removed from the polishing surface on the turntable, the motor increases a rotational speed of the turntable as compared to a rotational speed of the turntable at a period of polishing.

According to still another aspect of the present invention, there is provided a polishing apparatus for polishing a workpiece to be polished, comprising: a turntable having a polishing surface thereon; a top ring for holding the workpiece to be polished and pressing the workpiece against the polishing surface on the turntable; a motor for rotating the top ring; and a controller for controlling a rotational speed of the motor, wherein when a polished workpiece held by the top ring is to be removed from the polishing surface on the turntable, the motor increases a rotational speed of the top ring as compared to a rotational speed of the top ring at a period of polishing.

According to another aspect of the present invention, there is provided a polishing method comprising: moving a polishing surface and a top ring holding a workpiece to be polished relative to each other; pressing a surface, to be polished, of the workpiece held by the top ring against the polishing surface to polish the workpiece; and increasing a relative speed of the polishing surface and the top ring when a polished workpiece held by the top ring is to be removed from the polishing surface, as compared to a relative speed of the polishing surface and the top ring at a period of polishing.

It is desirable that the rotational speed of the turntable be increased to at least 100 revolutions per minute, and the rotational speed of the top ring be increased to at least 75 revolutions per minute.

According to the present invention, a liquid film thickness of a polishing liquid on the polishing surface is decreased by action of centrifugal force, so that surface tension due to the polishing liquid is reduced. Therefore, even if the top ring is lifted at the polishing position without an overhanging action, a workpiece can easily be removed from the polishing surface. Thus, the present invention can prevent the workpiece from being left on the polishing surface and being cracked or scratched. Further, since it is not necessary to perform the overhanging action, tact time for polishing can be reduced to increase throughput. Furthermore, when the rotational speed of the turntable is increased, components of the polishing liquid are scattered and discharged from an upper surface of the turntable by action of centrifugal force. Accordingly, it becomes easier to remove the workpiece from the polishing surface, and simultaneously polishing conditions for a subsequent workpiece to be polished can be arranged to be preferred conditions. As a result, throughput can be increased.

The above and other objects, features, and advantages of the present invention will be apparent from the following description when taken in conjunction with the accompanying drawings which illustrates preferred embodiments of the present invention by way of example.

DETAILED DESCRIPTION OF THE PREFERRED EMBODIMENTS

Figure 1:
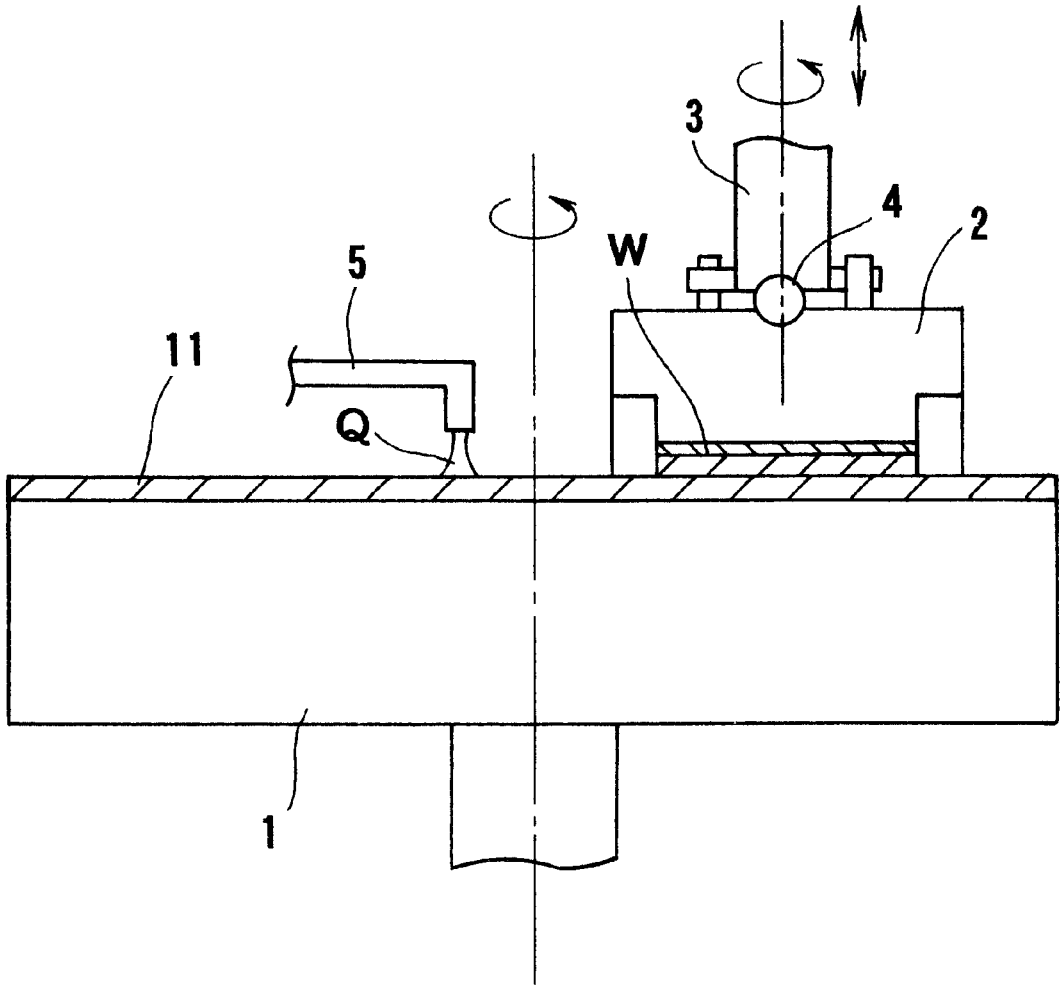
FIG. 1 is a schematic view showing a basic structure of a polishing apparatus.
Figure 2:
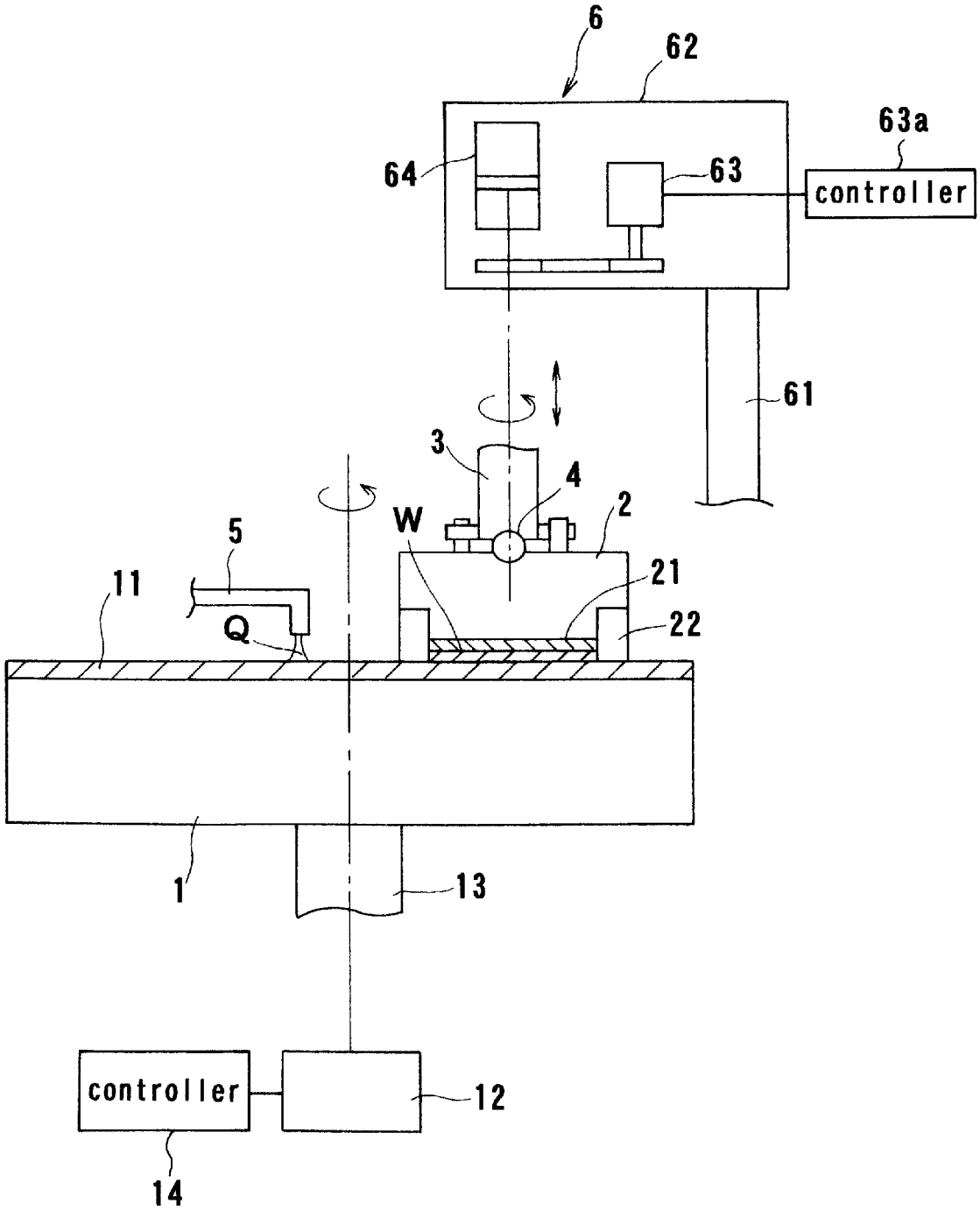
FIG. 2 is a front view showing an entire structure of a polishing apparatus according to an embodiment of the present invention.

A polishing method and apparatus according to an embodiment of the present invention will be described below with reference to FIG. 2. FIG. 2 is a front view showing an entire structure of a polishing apparatus according to an embodiment of the present invention. In FIG. 2, like parts and components are designated by the same reference numerals and characters as those shown in FIG. 1.

As shown in FIG. 2, the polishing apparatus according to the present embodiment comprises a turntable 1, a polishing liquid supply nozzle 5, and a top ring unit 6. The turntable 1 has a vertical shaft 13 coupled to a motor 12 disposed below the turntable 1 and is rotatable about an axis of the shaft 13, as indicated by an arrow in FIG. 1. The motor 12 is connected to a controller 14 for controlling a rotational speed of the motor 12. A polishing cloth 11 is attached on an upper surface of the turntable 1. The polishing cloth 11 has an upper polishing surface held in sliding contact with semiconductor wafer W (workpiece) to be polished. The polishing liquid supply nozzle 5 is disposed above the turntable 1, and a polishing liquid Q is supplied onto the polishing cloth 11 of the turntable 1 from the polishing liquid supply nozzle 5.

In the present embodiment, as described above, the turntable 1 has the polishing cloth 11 attached thereon. However, the turntable 1 is not limited to the one above, and the turntable 1 may comprise a polishing plate of a fixed abrasive, for example. The fixed abrasive comprises abrasive particles fixed by a binder.

As shown in FIG. 2, the top ring unit 6 mainly comprises a swing shaft 61, an arm-shaped top ring head 62 connected to the swing shaft 61, and a top ring 2 connected to a top ring shaft 3 extended downwardly from the top ring head 62. The top ring head 62 is swingable in a horizontal plane by rotation of the swing shaft 61. The top ring 2 is connected to a lower end of the top ring shaft 3 via a ball joint 4 so as to be tiltable with respect to the top ring shaft 3.

The top ring 2 of the top ring unit 6 has, on a lower surface thereof, an elastic pad 21 formed of polyurethane or the like. A semiconductor wafer W is attracted to a lower surface of the elastic pad 21 under a vacuum in such a state that the semiconductor wafer W is brought into contact with the lower surface of the elastic pad 21, so that the semiconductor wafer W is held by the top ring 2. The top ring 2 has a cylindrical guide ring 22 at an outer circumferential edge of a lower portion thereof. A lower portion of the guide ring 22 protrudes from the top ring 2, and hence a recess is formed at a radially inner side of the lower portion of the guide ring 22. The semiconductor wafer W is held in the recess for preventing the semiconductor wafer W from being dislodged from the lower surface of the top ring 2 during a polishing process.

The top ring 2 is coupled to a motor 63 provided in the top ring head 62 via the top ring shaft 3, and is rotatable about an axis of the top ring shaft 3. The motor 63 is connected to a controller 63*a* for controlling a rotational speed of the motor 63. The top ring 2 is also coupled to a lifting/lowering cylinder 64 via the top ring shaft 3, and is vertically movable for pressing the semiconductor wafer W held in the top ring 2 against the polishing cloth 11 under a predetermined pressure.

In the polishing apparatus thus constructed, the semiconductor wafer W held on the lower surface of the elastic pad 21 attached on the lower surface of the top ring 2 is pressed against the polishing cloth 11 on the turntable 1, while the polishing liquid Q is being supplied onto the polishing cloth 11 of the turntable 1 from the polishing liquid supply nozzle 5. The turntable 1 and the top ring 2 are independently rotated, so that the polishing cloth 11 and the semiconductor wafer W are moved relative to each other. For example, a suspension of fine polishing particles of silica or the like in an alkali solution is used as the polishing liquid supplied from the polishing liquid supply nozzle 5. Thus, the semiconductor wafer W is polished to a flat mirror finish by a combined effect of a chemical polishing effect attained by the alkali solution and a mechanical polishing effect attained by the polishing particles.

The semiconductor wafer W is polished in the above manner. After the polishing process of the semiconductor wafer W is completed, it is necessary to separate or remove the semiconductor wafer W from the polishing cloth 11 on the turntable 1. In this case, surface tension acts between the polishing cloth 11 and the semiconductor wafer W, as described above. According to the present invention, when the semiconductor wafer W is to be separated or removed from the polishing cloth 11, rotational speeds of the turntable 1 and the top ring 2 are increased by the motor 12 and the motor 63, respectively, as compared to their rotational speeds at a period of the polishing process. As a result, reduction of surface tension can be achieved as follows:

Specifically, when rotational speeds of the turntable 1 and the top ring 2 are increased, a liquid film thickness of the polishing liquid Q on the polishing cloth 11 is decreased by action of centrifugal force, so that surface tension due to the polishing liquid Q is reduced. Therefore, even if the top ring 2 is lifted at the polishing position without an overhanging action, the semiconductor wafer W can easily be removed from the polishing cloth 11. Thus, the present invention can prevent the semiconductor wafer W from being left on the polishing cloth 11 and being cracked or scratched. Further, since it is not necessary to perform the overhanging action, tact time for polishing can be reduced to increase throughput. Furthermore, when rotational speed of the turntable 1 is increased by the motor 12, components of the polishing liquid are scattered and discharged from an upper surface of the turntable 1 by action of centrifugal force. Accordingly, it becomes easier to remove the semiconductor wafer from the polishing surface, and simultaneously polishing conditions for a subsequent semiconductor wafer to be polished can be arranged to be preferred conditions. As a result, throughput can be increased.

Figure 3:
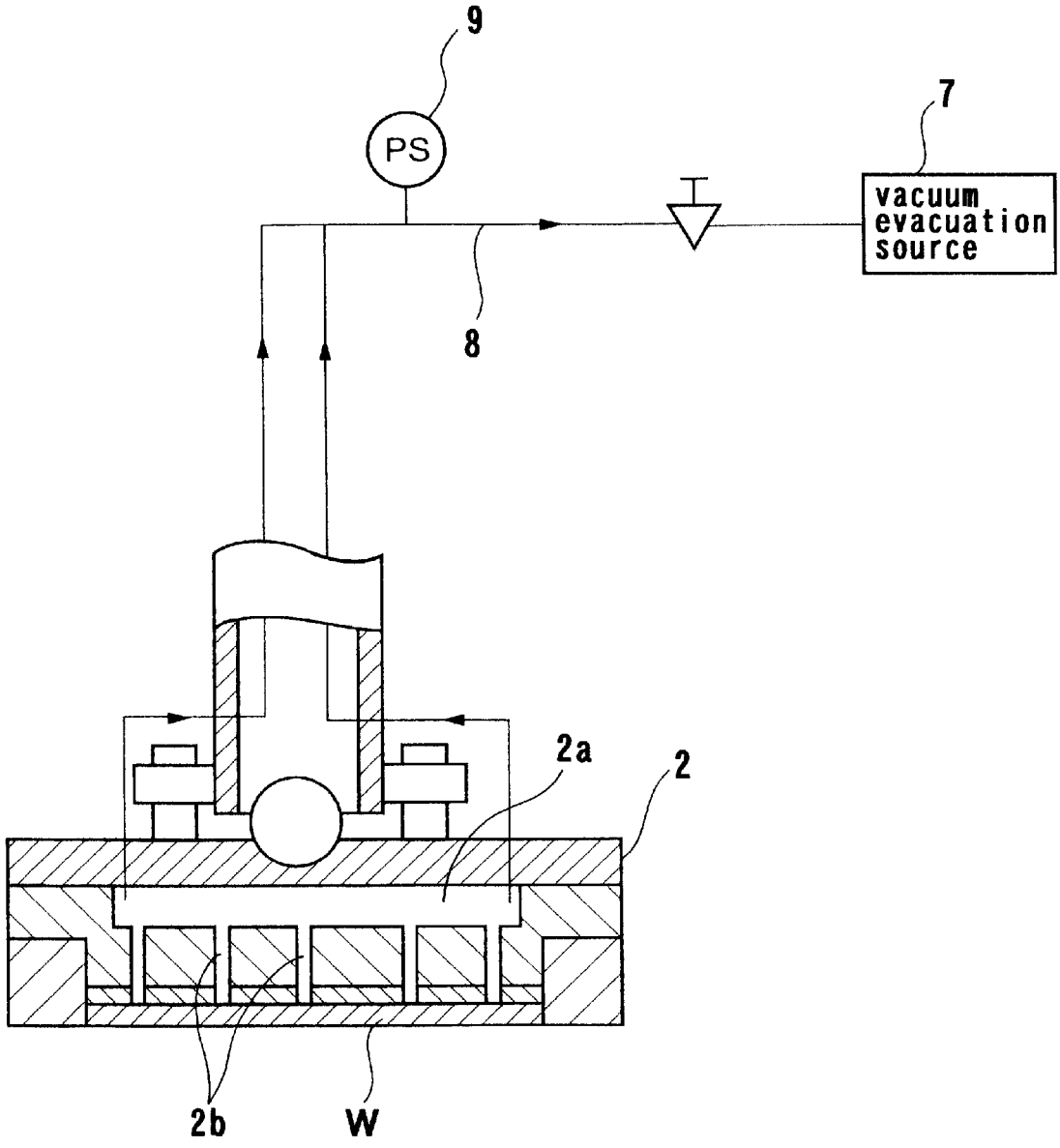
FIG. 3 is a schematic view showing a mechanism for vacuum attraction of a wafer according to an embodiment of the present invention.

In the present embodiment, as shown in FIG. 3, a vacuum line 8 communicating with a vacuum evacuation source 7 is connected to the top ring 2. The top ring 2 has a chamber (or a space) 2*a* connected to the vacuum line 8, and a plurality of holes 2*b* communicating with the chamber 2*a* and being open to a lower surface of the top ring 2. Thus, a semiconductor wafer W is held on the lower surface of the top ring 2 by vacuum attraction. When the semiconductor wafer W is to be removed from the polishing cloth 11, the top ring 2 is mechanically lifted. If the semiconductor wafer W is dislodged from the top ring 2 and is left on polishing cloth 11, a pressure of the vacuum line 8 changes to a vacuum nearer to the atmospheric pressure. Therefore, pressure of the vacuum line 8 is monitored to judge whether or not the semiconductor wafer W has normally been removed from the polishing cloth 11.

In the present embodiment, as shown in FIG. 3, a vacuum pressure sensor 9 is provided in the vacuum line 8 to measure and monitor pressure of the vacuum line 8, for thereby judging whether or not the semiconductor wafer W has normally been removed from the polishing cloth 11. Specifically, after a lifting operation of the top ring 2 is started, pressure of the vacuum line 8 is measured with the vacuum pressure sensor 9. If the measured value is less than a predetermined pressure value, it is judged that the semiconductor wafer W has normally been removed from the polishing cloth 11 in such a state that the semiconductor wafer W is attracted to the top ring 2. More specifically, if pressures that are at least 10 kPa larger than the predetermined pressure value; at which the semiconductor wafer W is judged to be normally attracted to the top ring 2, are measured for a predetermined period or longer, then it is judged that the semiconductor wafer W has been dislodged from the top ring 2.

Experiments were carried out as follows:

A strain gauge was provided in a top ring, and rotational speeds of a turntable and the top ring were respectively changed when a semiconductor wafer was to be removed from a polishing cloth. An axial force acting on the top ring at this time, i.e., a force for lifting the top ring, was measured.

A top ring for holding a semiconductor wafer having a diameter of 200 mm was used.

Dressing was performed for 600 seconds by a dresser before a polishing process.

After three semiconductor wafers were polished as dummies to obtain a normal condition of the polishing cloth, two semiconductor wafers were polished for measuring a force for lifting the top ring. The force for lifting the top ring was calculated based on an average of values measured after polishing of the two semiconductor wafers.

During the polishing process, the rotational speed of the turntable was 22 revolutions per minute, and the rotational speed of the top ring was 16 revolutions per minute.

When the semiconductor wafer was to be lifted, the rotational speed turntable was changed to 50 revolutions per minute, 75 revolutions per minute revolutions per minute, and the rotational speed of the top ring was changed revolutions per minute or 75 revolutions per minute.

As the dresser, a new dresser and a used dresser that had already used for processing 17,000 semiconductor wafers were used in the experiments, respectively.

The measurement results in the above experiments are shown in Table 1.

TABLE 1

| Rotational speed of turntable (revolutions/min) | Rotational speed of top ring (revolutions/min) | Force for lifting top ring in the case of new dresser (N) | Force for lifting top ring in the case of used dresser (N) |
|---|---|---|---|
| 50 | 55 | 332.1 | 342 |
| 75 | 55 | 99.9 | 378.9 |
| 100 | 55 | 378 | 185.4 |
| 50 | 75 | 389.7 | 300.9 |
| 75 | 75 | 338.7 | 178.8 |
| 100 | 75 | 25.9 | 96.6 |

From Table 1, it is shown that, in both cases of the new dresser and the used dresser, when the rotational speed of the turntable and the rotational speed of the top ring at a period of lifting a semiconductor wafer were the largest, i.e., when the rotational speed of the turntable was 100 revolutions per minute, and the rotational speed of the top ring was 75 revolutions per minute, a force for lifting the top ring was the lowest. In this case, the semiconductor wafer W could easily be lifted from the polishing cloth 11.

Figure 4A:
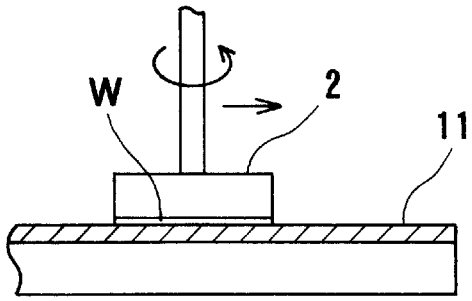
FIGS. 4A and 4B are schematic views showing an overhanging action.
Figure 4B:
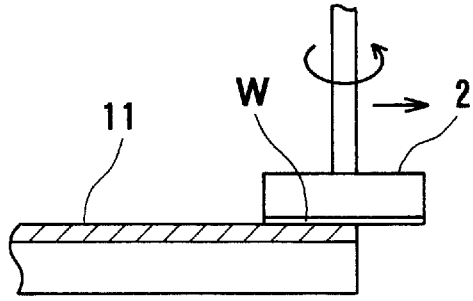

In the present embodiment, the top ring 2 is lifted at the polishing position without an overhanging action. However, the top ring 2 may perform an overhanging action after the polishing process, as shown in FIGS. 4A and 4B. After the polishing process is completed, the top ring 2 is moved to an outer circumferential edge of the polishing cloth 11 to partly expose a polished surface of the semiconductor wafer W beyond the outer circumferential edge of polishing cloth 11, and is then lifted to remove the semiconductor wafer W from the polishing cloth 11. When the semiconductor wafer W is to be separated or removed from the polishing cloth 11, the rotational speed of the top ring 2 is increased as compared to its rotational speed at a period of the polishing process. A liquid film thickness of polishing liquid on the polishing cloth 11 is decreased by action of centrifugal force, so that surface tension due to the polishing liquid is reduced by a synergistic effect of the centrifugal force and the overhanging action. Therefore, the semiconductor wafer W can more easily be removed from the polishing surface. As a result, the semiconductor wafer W can more effectively be prevented from being left on the polishing surface 11.

Figure 5:
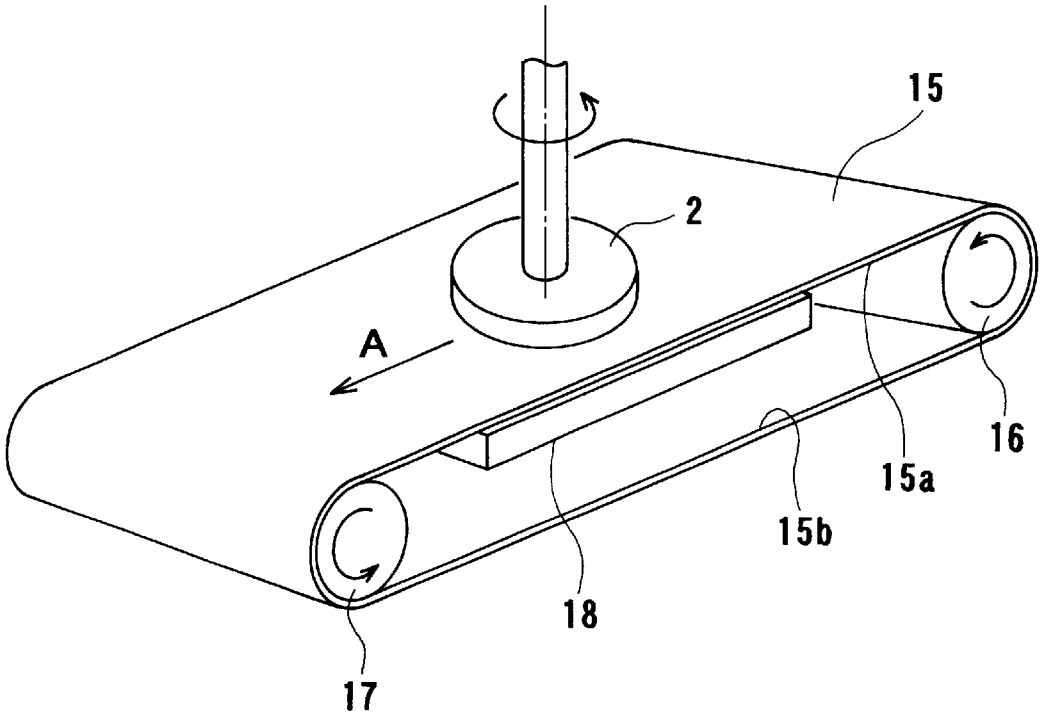
FIG. 5 is a schematic view showing a polishing apparatus according to another embodiment of the present invention.

In the present embodiment, the polishing surface is rotated to polish the semiconductor wafer. However, the polishing surface and the top ring may be moved relative to each other. In FIG. 5, a polishing surface is constituted by a belt 15 having abrasive particles on its surface. The belt 15 is wound on two rotatable drums 16, 17. The drums 16, 17, are rotated to linearly move the belt 15 along a direction indicated by arrow A. A support 18 is disposed between an upper belt surface 15*a* and a lower belt surface 15*b*. A semiconductor wafer held by top ring 2 is pressed against the belt 15 and the support 18. Thus, the semiconductor wafer is polished. When the semiconductor wafer is to be separated or removed from the belt 15, the rotational speed of the top ring 2 is increased as compared to the rotational speed at a period of the polishing process. As in the case of the aforementioned embodiment, the semiconductor wafer can be prevented from being left on the belt (polishing surface).

As described above, according to the present invention, when a polished workpiece held by a top ring is to be removed from a polishing surface on a turntable, a rotational speed of the turntable is increased as compared to a rotational speed of the turntable at a period of polishing. A relative speed of the turntable and the top ring is increased as compared to a relative speed of the turntable and the top ring at a period of polishing. Hence, even if the top ring is lifted at the polishing position without an overhanging action, the workpiece can easily be removed from the polishing surface. Thus, the present invention can prevent the workpiece from being left on the polishing surface and being cracked or scratched. Further, since it is not necessary to perform the overhanging action, tact time for polishing can be reduced to increase throughput. Furthermore, when the rotational speed of the turntable is increased, components of a polishing liquid are scattered and discharged from an upper surface of the turntable by action of centrifugal force. Accordingly, it becomes easier to remove the workpiece from the polishing surface, and simultaneously polishing conditions for a subsequent workpiece to be polished can be arranged to be preferred conditions. As a result, throughput can be increased.

Although certain preferred embodiments of the present invention have been shown and described in detail, it should be understood that various changes and modifications may be made therein without departing from the scope of the appended claims.

What is claimed is:

1. A polishing method comprising:

relatively rotating a turntable having a polishing surface thereon and a top ring holding a workpiece via a vacuum;

polishing a surface of said workpiece by pressing the surface of said workpiece held by said top ring against said polishing surface while relatively rotating said turntable and said top ring;

when said workpiece held by said top ring is to be removed from said polishing surface after polishing said surface of said workpiece, relatively rotating said turntable and said top ring at a rate that is greater than that at which said turntable and said top ring are relatively rotated during polishing of said surface of said workpiece; and sensing a pressure of the vacuum such that when the pressure is sensed to be greater than a predetermined value for at least a predetermined period of time said workpiece is determined to have been dislodged from said top ring.

2. The polishing method according to claim 1, wherein polishing a surface of said workpiece by pressing the surface of said workpiece held by said top ring against said polishing surface while relatively rotating said turntable and said top ring comprises pressing said surface of said workpiece held by said top ring against said polishing surface while rotating said turntable, and wherein relatively rotating said turntable and said top ring at a rate that is greater than that at which said turntable and said top ring are relatively rotated during polishing of said surface of said workpiece comprises rotating said turntable at a rate that is greater than that at which said turntable is rotated during polishing of said surface of said workpiece.

3. The polishing method according to claim 2, wherein rotating said turntable at a rate that is greater than that at which said turntable is rotated during polishing of said surface of said workpiece comprises rotating said turntable at a rate of at least 100 revolutions per minute.

4. The polishing method according to claim 1, wherein polishing a surface of said workpiece by pressing a surface of said workpiece held by said top ring against said polishing surface while relatively rotating said turntable and said top ring comprises pressing said surface of said workpiece held by said top ring against said polishing surface while rotating said turntable and said top ring, and wherein relatively rotating said turntable and said top ring at a rate that is greater than that at which said turntable and said top ring are relatively rotated during polishing of said surface of said workpiece comprises rotating said turntable at a rate that is greater than that at which said turntable is rotated during polishing of said surface of said workpiece and rotating said top ring at a rate that is greater than that at which said top ring is rotated during polishing of said surface of said workpiece.

5. The polishing method according to claim 4, wherein rotating said top ring at a rate that is greater than that at which said top ring is rotated during polishing of said surface of said workpiece comprises rotating said top ring at a rate of at least 75 revolutions per minute.

6. The polishing method according to claim 5, wherein rotating said turntable at a rate that is greater than that at which said turntable is rotated during polishing of said surface of said workpiece comprises rotating said turntable at a rate of at least 100 revolutions per minute.

7. The polishing method according to claim 1, further comprising lifting said top ring from said polishing surface, wherein sensing a pressure of the vacuum to determine whether said workpiece has been removed from said polishing surface comprises sensing the pressure of the vacuum after the lifting of said top ring.

8. A polishing apparatus comprising:

a turntable having a polishing surface thereon;

a top ring for holding a workpiece via a vacuum and pressing the workpiece against said polishing surface so as to polish the workpiece;

a motor for rotating said turntable;

a controller for controlling a rotational speed of said motor such that when the workpiece held by said top ring is to be removed from said polishing surface after the workpiece has been polished, a rotational speed of said motor increases whereby a rotational speed of said turntable increases to an amount that is greater than a rotational speed of said turntable during polishing of the workpiece; and a device for sensing a pressure of the vacuum to determine that the workpiece has been dislodged from said top ring when the pressure is sensed to be greater than a predetermined value for at least a predetermined period of time.

9. The polishing apparatus according to claim 8, wherein said controller is for controlling a rotational speed of said motor such that when the workpiece held by said top ring is to be removed from said polishing surface after the workpiece has been polished, the rotational speed of said motor increases whereby the rotational speed of said turntable increases to at least 100 revolutions per minute.

10. The polishing apparatus according to claim 8, wherein said device for sensing a pressure of the vacuum to determine whether the workpiece has been removed from said polishing surface is for sensing a pressure of the vacuum after said top ring has been lifted from said polishing surface.

11. A polishing apparatus comprising:

a turntable having a polishing surface thereon;

a top ring for holding a workpiece via a vacuum and pressing the workpiece against said polishing surface so as to polish the workpiece;

a motor for rotating said top ring;

a controller for controlling a rotational speed of said motor such that when the workpiece held by said top ring is to be removed from said polishing surface after the workpiece has been polished, a rotational speed of said motor increases whereby a rotational speed of said top ring increases to an amount that is greater than a rotational speed of said top ring during polishing of the workpiece; and a device for sensing a pressure of the vacuum to determine that the workpiece has been dislodged from said top ring when the pressure is sensed to be greater than a predetermined value for at least a predetermined period of time.

12. The polishing apparatus according to claim 11, wherein said controller is for controlling a rotational speed of said motor such that when the workpiece held by said top ring is to be removed from said polishing surface after the workpiece has been polished, the rotational speed of said motor increases whereby the rotational speed of said top ring increases to at least 75 revolutions per minute.

13. The polishing apparatus according to claim 11, wherein said device for sensing a pressure of the vacuum to determine whether the workpiece has been removed from said polishing surface is for sensing a pressure of the vacuum after said top ring has been lifted from said polishing surface.

14. A polishing method comprising:

relatively moving a polishing surface and a top ring holding a workpiece via a vacuum;

polishing a surface of said workpiece by pressing the surface of said workpiece held by said top ring against said polishing surface while relatively moving said polishing surface and said top ring;

when said workpiece held by said top ring is to be removed from said polishing surface after polishing said surface of said workpiece, relatively moving said polishing surface and said top ring at a rate that is greater than that at which said polishing surface and said top ring are relatively moved during polishing of said surface of said workpiece; and sensing a pressure of the vacuum such that when the pressure is sensed to be greater than a predetermined value for at least a predetermined period of time said workpiece is determined to have been dislodged from said top ring.

15. The polishing method according to claim 14, further comprising lifting said top ring from said polishing surface, wherein sensing a pressure of the vacuum to determine whether said workpiece has been removed from said polishing surface comprises sensing the pressure of the vacuum after the lifting of said top ring.

16. The polishing method according to claim 14, wherein polishing a surface of said workpiece by pressing the surface of said workpiece held by said top ring against said polishing surface while relatively moving said polishing surface and said top ring comprises pressing said surface of said workpiece held by said top ring against said polishing surface while relatively rotating said polishing surface and said top ring.

17. The polishing method according to claim 16, wherein polishing a surface of said workpiece by pressing the surface of said workpiece held by said top ring against said polishing surface while relatively rotating said polishing surface and said top ring comprises pressing said surface of said workpiece held by said top ring against said polishing surface while rotating said polishing surface, and wherein relatively rotating said polishing surface and said top ring at a rate that is greater than that at which said polishing surface and said top ring are relatively rotated during polishing of said surface of said workpiece comprises rotating said polishing surface at a rate that is greater than that at which said polishing surface is rotated during polishing of said surface of said workpiece.

18. The polishing method according to claim 17, wherein rotating said polishing surface at a rate that is greater than that at which said polishing surface is rotated during polishing of said surface of said workpiece comprises rotating said polishing surface at a rate of at least 100 revolutions per minute.

19. The polishing method according to claim 16, wherein polishing a surface of said workpiece by pressing the surface of said workpiece held by said top ring against said polishing surface while relatively rotating said polishing surface and said top ring comprises pressing said surface of said workpiece held by said top ring against said polishing surface while rotating said polishing surface and said top ring, and wherein relatively rotating said polishing surface and said top ring at a rate that is greater than that at which said polishing surface and said top ring are relatively rotated during polishing of said surface of said workpiece comprises rotating said polishing surface at a rate that is greater than that at which said polishing surface is rotated during polishing of said surface of said workpiece and rotating said top ring at a rate that is greater than that at which said top ring is rotated during polishing of said surface of said workpiece.

20. The polishing method according to claim 19, wherein rotating said top ring at a rate that is greater than that at which said top ring is rotated during polishing of said surface of said workpiece comprises rotating said top ring at a rate of at least 75 revolutions per minute.

21. The polishing method according to claim 20, wherein rotating said polishing surface at a rate that is greater than that at which said polishing surface is rotated during polishing of said surface of said workpiece comprises rotating said polishing surface at a rate of at least 100 revolutions per minute.

22. A polishing apparatus comprising:

a polishing surface;

a top ring for holding a workpiece via a vacuum and pressing the workpiece against said polishing surface so as to polish the workpiece;

a device for sensing a pressure of the vacuum to determine that the workpiece has been dislodged from said top ring when the pressure is sensed to be greater than a predetermined value for at least a predetermined period of time;

a motor for rotating said polishing surface while said top ring holds the workpiece and presses the workpiece against said polishing surface; and a controller for controlling a rotational speed of said motor such that when the workpiece held by said top ring is to be removed from said polishing surface after the workpiece has been polished, a rotational speed of said motor increases whereby a rotational speed of said polishing surface increases to an amount that is greater than a rotational speed of said polishing surface during polishing of the workpiece.

23. The polishing apparatus according to claim 22, wherein said device for sensing a pressure of the vacuum to determine whether the workpiece has been removed from said polishing surface is for sensing a pressure of the vacuum after said top ring has been lifted from said polishing surface.

24. The polishing apparatus according to claim 22, wherein said controller is for controlling a rotational speed of said motor such that when the workpiece held by said top ring is to be removed from said polishing surface after the workpiece has been polished, the rotational speed of said motor increases whereby the rotational speed of said polishing surface increases to at least 100 revolutions per minute.

25. A polishing apparatus comprising:

a polishing surface;

a top ring for holding a workpiece via a vacuum and pressing the workpiece against said polishing surface so as to polish the workpiece;

a device for sensing a pressure of the vacuum to determine that the workpiece has been dislodged from said top ring when the pressure is sensed to be greater than a predetermined value for at least a predetermined period of time;

a motor for rotating said top ring while said top ring holds the workpiece and presses the workpiece against said polishing surface; and a controller for controlling a rotational speed of said motor such that when the workpiece held by said top ring is to be removed from said polishing surface after the workpiece has been polished, a rotational speed of said motor increases whereby a rotational speed of said top ring increases to an amount that is greater than a rotational speed of said top ring during polishing of the workpiece.

26. The polishing apparatus according to claim 25, wherein said controller is for controlling a rotational speed of said motor such that when the workpiece held by said top ring is to be removed from said polishing surface after the workpiece has been polished, the rotational speed of said motor increases whereby the rotational speed of said top ring increases to at least 75 revolutions per minute.

* * * * *